US009337560B2

(12) United States Patent
Ohyama et al.

(10) Patent No.: US 9,337,560 B2
(45) Date of Patent: May 10, 2016

(54) CONNECTOR HAVING A MOUNTING SURFACE WITH ENGAGEMENT HOOKS OFFSET FROM EACH OTHER IN AN INSERTION DIRECTION OF A FLEXIBLE INTEGRATED WIRING

(71) Applicant: YAZAKI CORPORATION, Tokyo (JP)

(72) Inventors: Kouichi Ohyama, Makinohara (JP); Kazunori Miura, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/553,193

(22) Filed: Nov. 25, 2014

(65) Prior Publication Data

US 2015/0079831 A1 Mar. 19, 2015

Related U.S. Application Data

(63) Continuation of application No. PCT/JP2013/067073, filed on Jun. 21, 2013.

(30) Foreign Application Priority Data

Jun. 27, 2012 (JP) ..... 2012-143597
Jul. 2, 2012 (JP) ..... 2012-148742

(51) Int. Cl.
*H01R 13/62* (2006.01)
*H01R 12/77* (2011.01)
*H01R 12/79* (2011.01)

(52) U.S. Cl.
CPC ..... *H01R 12/774* (2013.01); *H01R 12/772* (2013.01); *H01R 12/79* (2013.01)

(58) Field of Classification Search
CPC .... H01R 12/77; H01R 12/772; H01R 12/774; H01R 12/79
USPC ..... 439/67, 329, 492, 352–360
See application file for complete search history.

(56) References Cited

U.S. PATENT DOCUMENTS 5,486,117 A * 1/1996 Chang ..... H01R 13/6275 439/353
6,022,242 A * 2/2000 Suzuki ..... H01R 23/667 439/495

(Continued)

FOREIGN PATENT DOCUMENTS

CN 102427179 A 4/2012
JP 2-16587 U 2/1990

(Continued)

OTHER PUBLICATIONS

English-Translation of International Search Report dated Sep. 17, 2013 issued in Application No. PCT/JP2013/067073 (PCT/ISA/210).

(Continued)

*Primary Examiner* — Chandrika Prasad
(74) *Attorney, Agent, or Firm* — Sughrue Mion, PLLC

(57) ABSTRACT

A flexible integrated wiring connector is used when a terminal portion of a flexible integrated wiring is inserted into and connected to a connector of a connection counterparty. The flexible integrated wiring connector includes a mounting surface on which the terminal portion is mounted; and a pair of engagement hooks which are formed respectively on both end sides of the mounting surface in a widthwise direction. The pair of engagement hooks engage with a pair of engagement holes which are bored respectively on both end sides of the terminal portion in the widthwise direction.

5 Claims, 19 Drawing Sheets

(56) References Cited

U.S. PATENT DOCUMENTS

| | | | | |
|---|---|---|---|---|
| 6,398,577 | B1 * | 6/2002 | Simmel | H01R 13/6275 439/341 |
| 7,798,819 | B2 * | 9/2010 | Kudo | H01R 13/26 439/567 |
| 8,267,700 | B2 * | 9/2012 | Mizoguchi | H01R 12/613 439/67 |
| 8,337,226 | B2 | 12/2012 | Yokoo | |
| 2003/0027450 | A1 * | 2/2003 | Nagata | H01R 13/6273 439/357 |
| 2010/0255705 | A1 * | 10/2010 | Higuchi | H01R 12/79 439/329 |
| 2012/0045919 | A1 | 2/2012 | Yokoo | |

FOREIGN PATENT DOCUMENTS

| | | | |
|---|---|---|---|
| JP | 2000-294314 | A | 10/2000 |
| JP | 2002-100425 | A | 4/2002 |
| JP | 2006-85989 | A | 3/2006 |
| JP | 2009-11380 | A | 1/2009 |
| JP | 2010-3443 | A | 1/2010 |
| JP | 2011-40226 | A | 2/2011 |
| JP | 2011-44381 | A | 3/2011 |

OTHER PUBLICATIONS

Written Opinion dated Sep. 17, 2013 issued in International Application No. PCT/JP2013/067073 (PCT/ISA/237).

Written Opinion, Issued by the International Searching Authority, Dated Sep. 17, 2013, in counterpart International Application No. PCT/JP2013/067073.

Communication dated Nov. 27, 2015 issued by Japanese Intellectual Property Office in counterpart Japanese Patent Application No. 2012-143597.

Communication dated Jan. 26, 2016 issued by Japanese Intellectual Property Office in counterpart Japanese Patent Application No. 2012-148742.

Communication from the State Intellectual Property Office of P.R. China dated Feb. 29, 2016 in a counterpart Chinese application No. 201380034782.4.

* cited by examiner

SEC. A-A

DETAIL B

DETAIL D

CONNECTOR HAVING A MOUNTING SURFACE WITH ENGAGEMENT HOOKS OFFSET FROM EACH OTHER IN AN INSERTION DIRECTION OF A FLEXIBLE INTEGRATED WIRING

CROSS REFERENCE TO RELATED APPLICATIONS

This application is a continuation of PCT application No. PCT/JP13/067073, which was filed on Jun. 21, 2013 based on Japanese Patent Application (No. 2012-143597) filed on Jun. 27, 2012 and Japanese Patent Application (No. 2012-148742) filed on Jul. 2, 2012, the contents of which are incorporated herein by reference.

BACKGROUND OF THE INVENTION

The present invention relates to a flexible integrated wiring connector.

For interconnection between various types of electronic devices or electric devices, flexible integrated wiring such as a flexible flat cable (FFC) or flexible printed circuits (FPC) have been used in order to reduce wiring space and to improve the degree of freedom in a wiring path. A terminal portion of such flexible integrated wiring is usually connected to another electrical circuit through a detachable flexible integrated wiring connector (see PTL 1 to PTL 3).

Here, the flexible integrated wiring connector disclosed in PTL 1 will be described with reference to FIGS. 6 and 7. As shown in FIGS. 6 and 7, a flexible integrated wiring connector 1 disclosed in PTL 1 includes a slider 5 provided with a mounting surface 4 on which a terminal portion 3 of a flexible integrated wiring 2 is mounted, and a cover 6 which is assembled to the slider 5 and presses the terminal portion 3 of the flexible integrated wiring 2 against the mounting surface 4 of the slider 5.

In the slider 5, positioning bosses 7*a* are formed on both end sides of the mounting surface 4 in the widthwise direction thereof (that is, in an X direction in FIG. 7), and protrusions 7*b* are formed in both side surfaces continued to both the ends. In addition, the cover 6 is constituted by a longitudinal member 6*a* extending in an arrangement direction of the terminal portion 3 in the flexible integrated wiring 2, and engagement members 6*b* which hang along the side surfaces of the slider 5 from both ends of the longitudinal member 6*a* and are provided with openings capable of engaging with the respective protrusions 7*b* formed in the side surfaces. In the flexible integrated wiring 2, boss holes 2*a* and 2*a* are bored at the respective locations corresponding to the positioning bosses 7*a* and 7*a*.

At the time of assembling the flexible integrated wiring connector 1 to the terminal portion 3 of the flexible integrated wiring 2, first, the positioning bosses 7*a* and 7*a* of the slider 5 are inserted into the boss holes 2*a* and 2*a* of the flexible integrated wiring 2 to thereby install the terminal portion 3 on the mounting surface 4 of the slider 5. Then, the engagement members 6*b* of the cover 6 engage with the protrusions 7*b* of the side surfaces of the slider 5 by covering the flexible integrated wiring 2 with the longitudinal member 6*a* of the cover 6, and the flexible integrated wiring 2 comes into close contact with the slider 5.

[PTL 1] JP-A-2011-44381
[PTL 2] JP-A-2011-40226
[PTL 3] JP-A-2010-3443

SUMMARY OF THE INVENTION

However, in the flexible integrated wiring 2, an extension portion may be used in a bent state depending on a wiring layout in a state where the flexible integrated wiring is assembled to various types of electronic devices or electric devices or handling (that is, how to hold) in a state where the flexible integrated wiring is assembled to the flexible integrated wiring connector 1. In this case, there is the possibility of the terminal portion 3 of the flexible integrated wiring 2 being deflected and deformed.

FIGS. 8A and 8B are diagrams showing an example of the deflection deformation of the terminal portion 3 when an extension portion 8 continued to the terminal portion 3 of the flexible integrated wiring 2 is used in a bent state. FIG. 8A is a side view of the flexible integrated wiring connector 1, and FIG. 8B is a diagram when the flexible integrated wiring connector 1 is viewed from the terminal portion 3 side. Meanwhile, a dashed line in FIG. 8A indicates a state where the extension portion 8 of the flexible integrated wiring 2 is not bent. The bent extension portion 8 is not shown in FIG. 8B in describing the deflection deformation of the terminal portion 3 of the flexible integrated wiring 2.

As shown in FIG. 8A, when the extension portion 8 of the flexible integrated wiring 2 is set to be in an inclined state by being bent upwards in FIG. 8A with respect to the mounting surface 4, an elastic force is applied to the terminal portion 3 of the flexible integrated wiring 2 in a direction in which the bending is restored (that is, downwards in FIG. 8A). Here, an elastic force is applied to the terminal portion 3 of the flexible integrated wiring 2 in a direction in which the bending is restored with respect to the entirety in an arrangement direction of the terminal portion 3 (that is, in a widthwise direction of the terminal portion 3). When an elastic force is applied in a direction in which the bending is restored in a state where the flexible integrated wiring 2 is pressed against the cover 6, both a central portion of the terminal portion 3 of the flexible integrated wiring 2 in the arrangement direction and the longitudinal member 6*a* of the cover 6 are deflected and deformed in a concave shape, as shown in FIG. 8B. That is, both end portions of the longitudinal member 6*a* of the cover 6 engage with the protrusions 7*b* of the side surfaces of the slider 5 through the engagement members 6*b*, while the central portion of the longitudinal member 6*a* does not engage with the slider 5. For this reason, the central portion of the longitudinal member 6*a* is deflected and deformed due to a shortage of a reaction force caused by the thickness thereof. As a result, there is the possibility of electrical reliability being degraded due to a decrease in adhesiveness between the flexible integrated wiring 2 and the flexible integrated wiring connector 1 or a fitting failure with a connector of a connection counterparty.

In response, a method is considered of preventing the cover 6 and the terminal portion 3 from being deflected and deformed with respect to the pressing from the terminal portion 3 in the flexible integrated wiring 2, for example, by increasing the thickness of the longitudinal member 6*a* in the cover 6 and increasing the reaction force. However, as shown in FIG. 9, clearance dimensions of a printed circuit board (hereinafter, referred to as a PCB) 9 and the cover 6 at the time of connecting (that is, at the time of fitting) the flexible integrated wiring connector 1 to a printed circuit board (PCB) connector 10 are extremely small, and thus there is a restriction in increasing the thickness of the longitudinal member 6*a* of the cover 6.

That is, when the thickness of the cover 6 is increased, the PCB 9 and the cover 6 may come into contact with each other due to the extremely small clearance dimensions of the cover 6 and the PCB 9 as shown in FIG. 9, and thus it is not possible to fit the flexible integrated wiring connector 1 to the PCB connector 10. In addition, when the PCB 9 and the cover 6 come into contact with each other, there is the possibility of a pattern of the PCB 9 being influenced by disconnection or the like. Further, when the cover 6 and the PCB 9 come into contact with each other, an excessive force may be applied to a contact point of the PCB connector 10 with the flexible integrated wiring connector 1, which may result in a terminal deformation and a contact failure. In addition, a method is considered of preventing the cover 6 and the PCB 9 from coming into contact with each other by causing the contact point of the PCB connector 10 with the flexible integrated wiring connector 1 to be located at a higher position. However, in a case of the method, the PCB connector 10 may increase in size. Since there is a strong need for a reduction in the size of the PCB connector 10, the method cannot be adopted.

The invention is contrived in view of the above-described situations, and an object thereof is to provide a flexible integrated wiring connector capable of suppressing the deflection of a flexible integrated wiring in a direction opposite to a mounting surface.

In order to accomplish the above-described object, a flexible integrated wiring connector according to the invention has characteristics of (1) to (5) below.

(1) A flexible integrated wiring connector which is used when a terminal portion of a flexible integrated wiring is inserted into and connected to a connector of a connection counterparty, the flexible integrated wiring connector including a mounting surface on which the terminal portion is mounted, and a pair of engagement hooks which are formed respectively on both end sides of the mounting surface in a widthwise direction. The pair of engagement hooks engage with a pair of engagement holes which are bored respectively on both end sides of the terminal portion in the widthwise direction.

(2) The flexible integrated wiring connector according to (1) described above, wherein a width between the pair of engagement hooks is slightly smaller than a width between the pair of engagement holes.

(3) The flexible integrated wiring connector according to (1) or (2) described above, wherein a protrusion portion is formed in each of both ends of the mounting surface in the widthwise direction.

(4) The flexible integrated wiring connector according to any one of (1) to (3) described above, wherein a tapered portion is formed on each of both end sides of the mounting surface in the widthwise direction, the tapered portion being inclined so that an amount of protrusion thereof increases toward the both end sides from a center side.

(5) The flexible integrated wiring connector according to any one of (1) to (4) described above, wherein the engagement hook includes an engraved portion which is formed on the mounting surface, an arm portion, having flexibility, which extends from a bottom of the engraved portion and is formed to protrude further than the mounting surface, and a barb portion which protrudes from a protrusion end of the arm portion and engages with the engagement hole.

According to the invention, it is possible to provide a flexible integrated wiring connector capable of suppressing the deflection of a flexible integrated wiring in a direction opposite to a mounting surface.

BRIEF DESCRIPTION OF THE DRAWINGS

FIG. 1A is a side view when viewed from a terminal portion side.

FIG. 4A is a plan view, and FIG. 4B is a cross-sectional view taken along line C-C of FIG. 4A.

FIG. 8A is a side view of a flexible integrated wiring connector, and FIG. 8B is a diagram when the flexible integrated wiring connector is viewed from the terminal portion side.

FIG. 14A is a plan view when viewed from above, and FIG. 14B is an enlarged view of a portion of FIG. 14A.

FIG. 15A is a plan view when viewed from above, and FIG. 15B is an enlarged view of a portion of FIG. 15A.

DETAILED DESCRIPTION OF THE EXEMPLARY EMBODIMENTS

First Embodiment

Hereinafter, a flexible integrated wiring connector according to a first embodiment will be described in detail with reference to FIGS. 1 to 5.

Figure 1A:
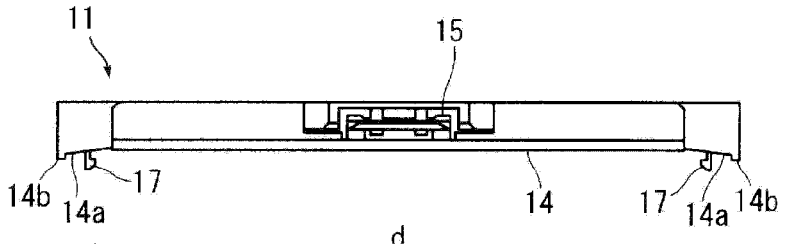
FIG. 1A to FIG. 1(*d*) are diagrams showing a flexible integrated wiring connector according to a first embodiment.
Figure 1D:
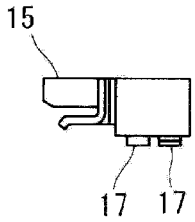
FIG. 1B is a plan view.
FIG. 1C is a cross-sectional view taken along line A-A of FIG. 1B, and FIG. 1(*d*) is a side view when viewed from a side surface side.

FIGS. 1A to 1(*d*) are diagrams showing a flexible integrated wiring connector 11 according to this embodiment. FIG. 1A is a side view when viewed from a terminal portion side, FIG. 1B is a plan view, FIG. 1C is a cross-sectional view taken along line A-A of FIG. 1B, and FIG. 1(*d*) is a side view when viewed from a side surface side.

In the flexible integrated wiring connector 11, a mounting surface 14 having a terminal portion 13 of a flexible integrated wiring 12 being mounted thereon is formed along the widthwise direction (that is, a horizontal direction in FIG. 1A) of one surface thereof (lower surface in FIG. 1A). In addition, a pair of engagement hooks 17 and 17, which are inserted into a pair of engagement holes 12*a* and 12*b* formed respectively on both end sides of the terminal portion 13 of the flexible integrated wiring 12 in the widthwise direction, are provided to stand on both end portion sides of the mounting surface 14 in the widthwise direction.

Figure 2:
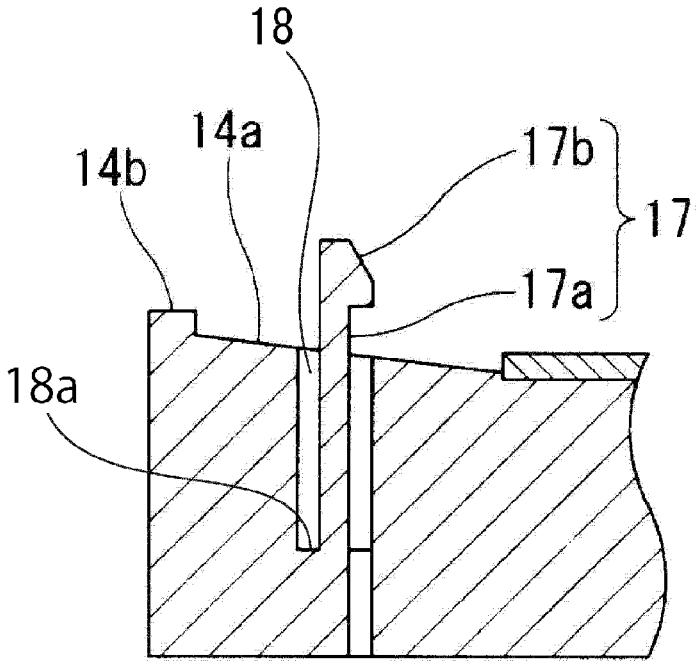
FIG. 2 is a partially enlarged view showing the flexible integrated wiring connector according to the first embodiment, and is an enlarged view of a portion B of FIG. 1C.

As shown in FIG. 2, each of the engagement hooks 17 and 17 is constituted by a base portion 17*a* which is provided to stand from the mounting surface 14 and a protrusion portion 17*b* which protrudes to the central side from the base portion 17*a* in an arrangement direction of the terminal portion. In other words, the engagement hooks 17 and 17 include an engraved portion 18 formed in the mounting surface 14, the base portions 17*a* (arm portions), having flexibility, which extend from a bottom 18*a* of the engraved portion 18 and are formed to protrude further than the mounting surface 14, and the protrusion portions 17*b* (barb portions) which protrude from protrusion ends of the base portions 17*a* and engage with the engagement holes 12*a* and 12*b*, respectively.

Figure 1B:
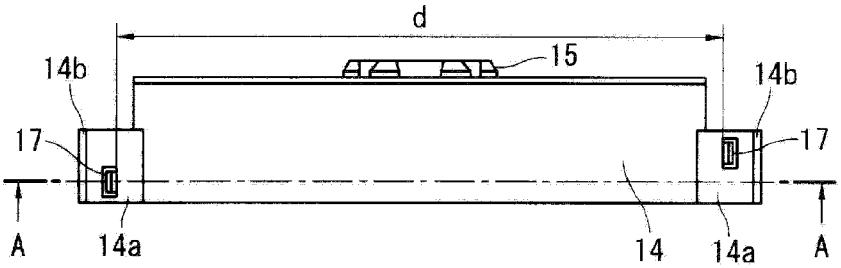
Figure 1C:
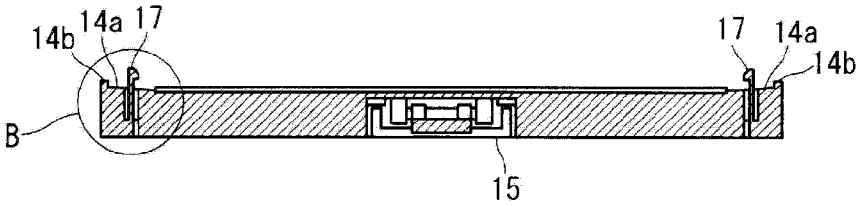

A width d between the engagement hooks 17 and 17 shown in FIG. 1B is designed to be slightly smaller than a width D between the engagement holes 12*a* and 12*b* of the flexible integrated wiring 12. As shown in FIG. 1B, the engagement hooks 17 and 17 are provided to be shifted from each other in an insertion direction of the flexible integrated wiring 12. This is for the purpose of preventing a conductor exposed surface 12*c* of the flexible integrated wiring 12 from being mounted toward the mounting surface 14 side.

In the mounting surface 14 of the flexible integrated wiring connector 11, the central portion thereof in the widthwise direction is formed in a planar shape. On each of both end sides of the mounting surface 14 in the widthwise direction (that is, the vicinity of the engagement hook 17), a tapered portion 14*a* inclined to the flexible integrated wiring side toward both end sides from the central portion side is formed. That is, the tapered portion 14*a* is inclined so that the amount of protrusion thereof increases toward both end sides from the central side. In addition, a protrusion portion 14*b* protruding to the flexible integrated wiring 12 side is formed in each of both ends of the mounting surface 14 in the widthwise direction. That is, the protrusion portion 14*b* is disposed to be closer to both end sides than the tapered portion 14*a* in the mounting surface 14.

As the flexible integrated wiring 12 (see FIG. 3) according to the first embodiment, it is possible to use a flexible flat cable (FFC) in which a plurality of arranged foil-like conductors are interposed in an insulating film and terminal portions of the conductors are exposed by notching the insulating film on one surface for connection with another electrical circuit. In addition, as the flexible integrated wiring 12, it is possible to use a flexible wiring substrate (FPC) in which a terminal portion constituted by a plurality of foil-like conductors is formed in the substrate edge thereof in order to connect an electrical circuit formed on a flexible substrate to an external electrical circuit. In the flexible integrated wiring 12, an extension portion continued to the terminal portion 13 is formed to have an appropriate length depending on the usage, but is omitted for the purpose of simplifying the illustration.

Figure 3:
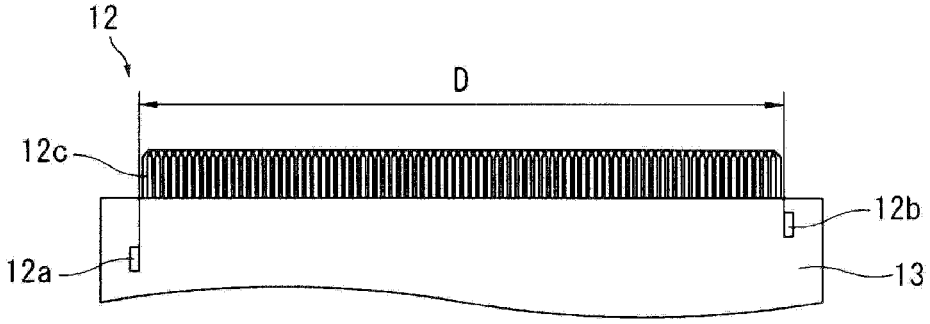
FIG. 3 is a diagram showing a terminal portion of a flexible integrated wiring according to the first embodiment.

As shown in FIG. 3, in the flexible integrated wiring 12, the engagement holes 12*a* and 12*b* having the engagement hooks 17 and 17 of the flexible integrated wiring connector 11 being inserted thereinto are bored respectively in both edges of the terminal portion 13 in the widthwise direction. The width D between the engagement holes 12*a* and 12*b* is designed to be slightly wider than the width d between the engagement hooks 17 and 17. In addition, the engagement holes 12*a* and 12*b* are provided to be shifted from each other in the insertion direction in a similar manner to the engagement hooks 17 and 17.

In the flexible integrated wiring 12, the engagement holes 12*a* and 12*b* are aligned with the engagement hooks 17 and 17 of the flexible integrated wiring connector 11, and the engagement hooks 17 and 17 are inserted into the engagement holes 12*a* and 12*b*, and thus the flexible integrated wiring 12 engages with the protrusion portion 17*b* and is assembled to the flexible integrated wiring connector 11.

Figure 4A:
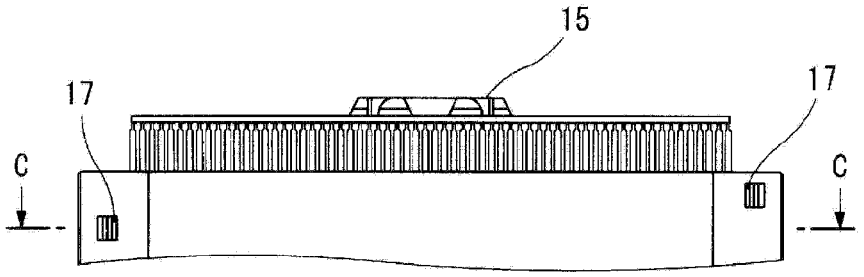
FIG. 4A and FIG. 4B are diagrams showing a state where the flexible integrated wiring is assembled to the flexible integrated wiring connector.
Figure 4B:
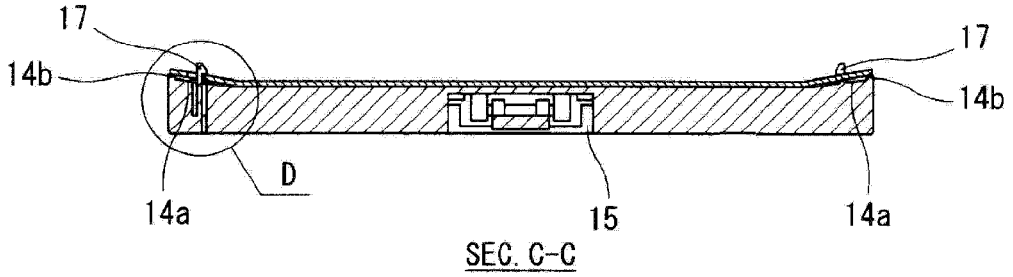
Figure 5:
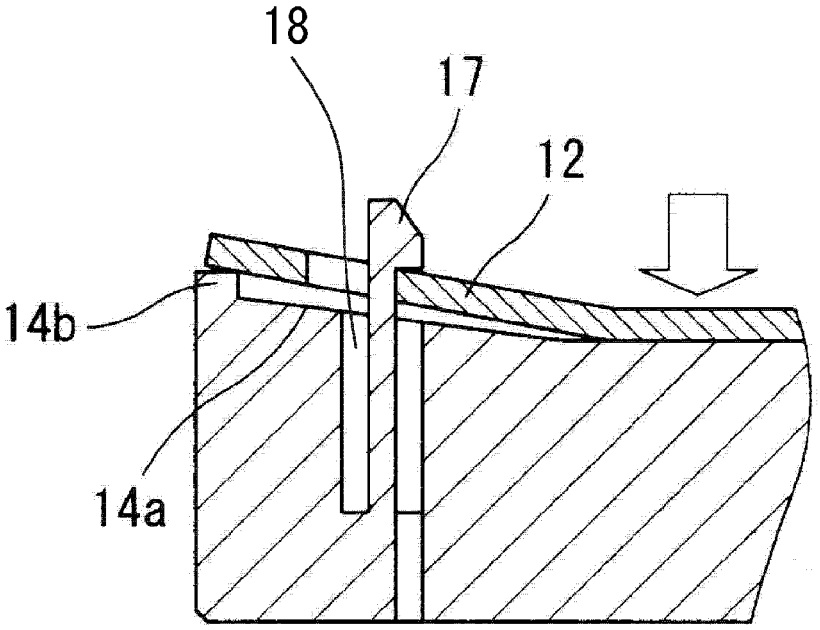
FIG. 5 is a cross-sectional view showing a state where the flexible integrated wiring is assembled to the flexible integrated wiring connector, and is an enlarged view of a portion D of FIG. 4B.
Figure 6:
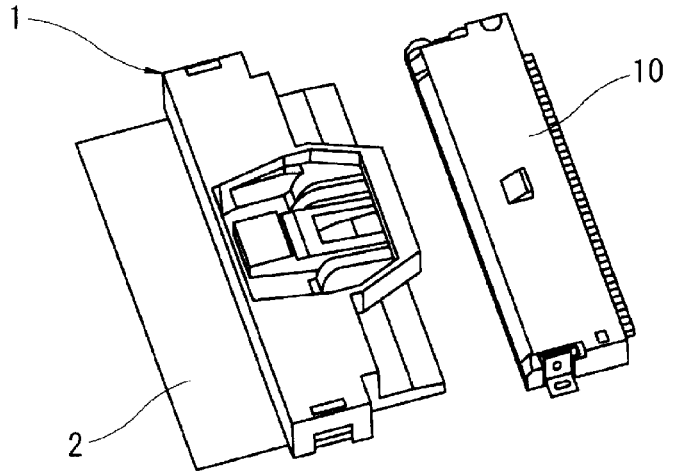
FIG. 6 is a perspective view showing a flexible integrated wiring connector and a PCB connector of the related art.
Figure 7:
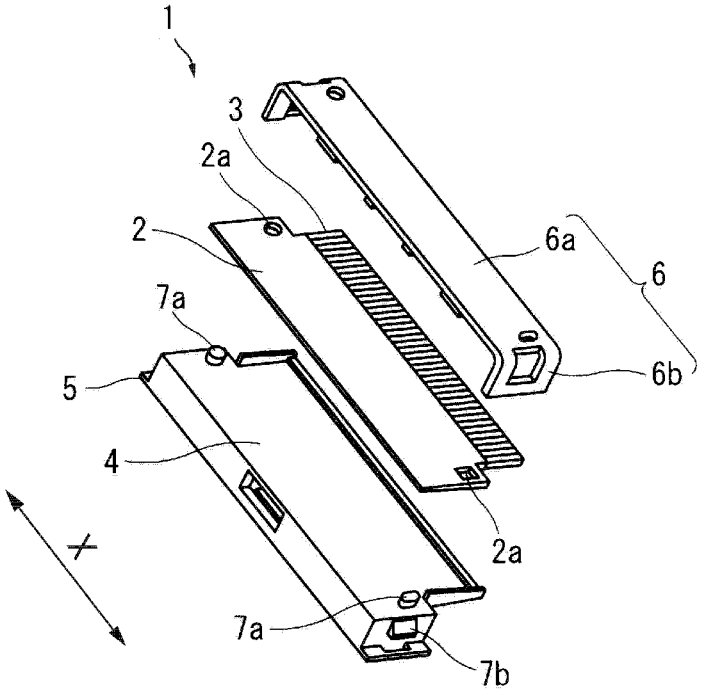
FIG. 7 is an exploded view showing the flexible integrated wiring connector of the related art.
Figure 8A:
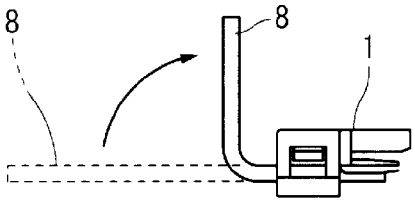
FIG. 8A and FIG. 8B are diagrams showing the deflection deformation of a terminal portion when an extension portion of a flexible integrated wiring is used in a bent state.
Figure 8B:
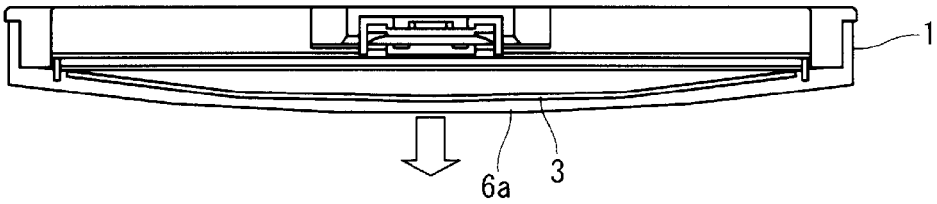
Figure 9:
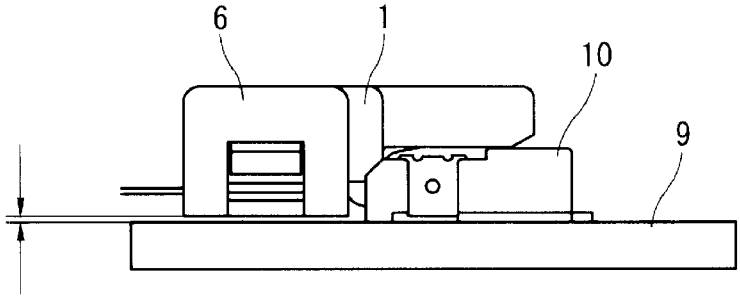
FIG. 9 is a diagram showing a state where a flexible integrated wiring connector and a PCB connector come into contact with each other.

FIGS. 4A to 5 are diagrams showing a state where the flexible integrated wiring 12 is assembled to the flexible integrated wiring connector 11. FIG. 4A is a plan view, and FIG. 4B is a cross-sectional view taken along line C-C of FIG. 4A. FIG. 5 is an enlarged view of one end side.

When the flexible integrated wiring 12 is assembled to the flexible integrated wiring connector 11, the flexible integrated wiring 12 is deflected due to the width D between the engagement holes 12*a* and 12*b* of the flexible integrated wiring 12 being designed to be larger than the width d between the engagement hooks 17 and 17 of the flexible integrated wiring connector 11. At this time, both side edges of the flexible integrated wiring 12 are pushed up from the protrusion portions 14*b* of both end portions in the flexible integrated wiring connector 11, and thus a direction in which the flexible integrated wiring is deflected is forced to the mounting surface 14 side. In addition, since the flexible integrated wiring 12 follows the shape of the tapered portion 14*a*, the flexible integrated wiring 12 is pressed against the mounting surface 14 of the flexible integrated wiring connector 11.

In this manner, the flexible integrated wiring 12 assembled to the flexible integrated wiring connector 11 is inserted into, for example, an insertion opening of a PCB connector (that is, a connector of a connection counterparty) which is mounted on a printed circuit board (PCB) not shown in the drawing, and the terminal portion 13 of the flexible integrated wiring 12 is connected to a connection terminal which is provided within the PCB connector.

Accordingly, since the flexible integrated wiring 12 is fixed by the flexible integrated wiring connector 11 in spite of the flexibility of the wiring, the flexible integrated wiring 12 can be stably inserted and connected against an insertion resistance on the PCB connector side. In addition, in a state where the flexible integrated wiring 12 is inserted into and connected to the PCB connector, an engagement member 15 formed in the flexible integrated wiring connector 11 engages with a protrusion of the PCB connector and is inserted thereinto.

As described above, according to the flexible integrated wiring connector 11 of this embodiment, even when an elastic force in which the terminal portion 13 of the flexible integrated wiring 12 attempts to rise up from the mounting surface 14 acts due to the extension portion of the flexible integrated wiring 12 being used in a bent state, it is possible to always bring the terminal portion 13 of the flexible integrated wiring 12 into close contact with the mounting surface 14 of the flexible integrated wiring connector 11. That is, since the width d between the engagement hooks 17 and 17 is smaller than the width D between the engagement holes 12*a* and 12*b*, the terminal portion 13 is deflected. At this time, the direction in which the terminal portion 13 is deflected is forced to the mounting surface 14 side by the protrusion portions 14*b* of both ends of the mounting surface 14. In addition, the flexible integrated wiring 12 is deformed so as to follow the shape of the tapered portion 14*a*, by the tapered portions 14*a*. As a result, it is possible to suppress the deflection deformation of the terminal portion 13 of the flexible integrated wiring 12 in a direction opposite to the mounting surface 14 and to stably secure electrical reliability.

In addition, also in a normal state where the extension portion of the flexible integrated wiring 12 is not bent, the terminal portion 13 of the flexible integrated wiring 12 is forcibly deflected and deformed to the mounting surface 14 side. Thus, it is possible to increase adhesiveness between the terminal portion 13 of the flexible integrated wiring 12 and the mounting surface 14 of the flexible integrated wiring connector 11. Therefore, it is possible to secure stable electrical reliability.

Further, the flexible integrated wiring connector 11 according to the first embodiment does not require a cover as compared with that of the related art, and thus it is possible to reduce the number of components and to contribute to a reduction in costs. In addition, since it is not necessary to improve a reaction force by increasing the thickness of the cover, it is possible to suppress the occurrence of a fitting failure between the flexible integrated wiring connector 11 and the PCB connector which occurs due to the contact between the cover and the PCB, the disconnection of a PCB pattern, a terminal deformation, a contact failure, an increase in the size of the PCB connector, and the like.

Here, characteristics of the flexible wiring connector according to the first embodiment described above will be collectively listed in (1) to (5) below in a concise manner.

(1) The flexible integrated wiring connector 11 according to the first embodiment is used when the terminal portion 13 of the flexible integrated wiring 12 is inserted into and connected to a connector of a connection counterparty. The flexible integrated wiring connector 11 includes the mounting surface 14 on which the terminal portion 13 is mounted, and the pair of engagement hooks 17 and 17 formed respectively on both end sides of the mounting surface 14 in the widthwise direction. The pair of engagement hooks 17 and 17 engage with the pair of engagement holes 12*a* and 12*b* which are bored respectively on both end sides of the terminal portion 13 in the widthwise direction.

(2) In the flexible integrated wiring connector 11 according to the first embodiment, the width between the pair of engagement hooks 17 and 17 is slightly smaller than the width between the pair of engagement holes 12*a* and 12*b*.

(3) In the flexible integrated wiring connector 11 according to the first embodiment, the protrusion portion 14*b* is formed in each of both ends of the mounting surface 14 in the widthwise direction.

(4) In the flexible integrated wiring connector 11 according to the first embodiment, the tapered portion 14*a* is formed on each of both end sides of the mounting surface 14 in the widthwise direction, the tapered portion being inclined so that the amount of protrusion thereof increases toward both end sides from the central side.

(5) In the flexible integrated wiring connector 11 according to the first embodiment, the engagement hooks 17 and 17 include the engraved portion 18 formed in the mounting surface 14, the base portions 17*a* (arm portions), having flexibility, which extend from the bottom 18*a* of the engraved portion 18 and are formed to protrude further than the mounting surface 14, and the protrusion portions 17*b* (barb portions) which protrude from protrusion ends of the base portions 17*a* and engage with the engagement holes 12*a* and 12*b*, respectively.

Although the invention is described in detail with reference to the embodiments, it is apparent that various modifications and amendments may be made by those skilled in the art without departing from the spirit and scope of the invention.

For example, an inclination angle of the tapered portion 14*a* in the mounting surface 14, the size of the protrusion portion 14*b*, and the like can be appropriately selected depending on the dimensions of the flexible integrated wiring connector 11 and the flexible integrated wiring 12, and the like.

In addition, the engagement hook 17 is not limited to the shape described in the first embodiment, and can be appropriately selected as long as it is capable of engaging with the flexible integrated wiring 12.

Second Embodiment

Next, a description will be given of a second embodiment related to an assembly structure for assembling a flat cable to a guide member (that is, a slider) which is used at the time of inserting the flat cable into a connector for connection.

Hitherto, a flexible cable having a flat plate shape (hereinafter, referred to as a flat cable), such as a flexible printed circuit (FPC) or a flexible flat cable (FFC), has been widely used as a connecting wiring in order to achieve a reduction in wiring space and an improvement in the degree of freedom of a wiring path in various types of electronic device and electric devices. In the FPC, a terminal portion constituted by a plurality of foil-like conductors is formed in a substrate edge in order to connect an electrical circuit formed on a flexible substrate to an external electrical circuit. In addition, the FFC is formed such that the plurality of arranged foil-like conductors are interposed in an insulating film and terminal portions used for connection with another electrical circuit are provided in both ends thereof. The flat cables are usually connected to another electrical circuit through a detachable connector.

The terminal portion of the flat cable has a low stiffness, and has a problem in that the terminal portion may be deformed due to an insertion resistance when being inserted into the connector, or in that the terminal portion may not be sufficiently inserted. Consequently, a connection mode is adopted in which a terminal connection tool having stiffness is assembled to the terminal portion of the flat cable and is inserted into the connector through the assembled terminal connection tool (see PTL 3). Meanwhile, a terminal for connection with another electrical circuit is provided within the connector. Accordingly, a terminal of the connector comes into contact with the terminal portion (conductor) of the flat cable by inserting the terminal connection tool into the connector, and the terminal and the terminal portion (conductor) are electrically connected to each other.

PTL 3 discloses a configuration of the terminal connection tool that includes a guide member (hereinafter, referred to as a slider) having a mounting surface on which the terminal portion of the flat cable is mounted, and a cover that presses the terminal portion of the flat cable, which is mounted on the mounting surface, against the mounting surface. Meanwhile, the slider is an interface member that guides the flat cable at the time of inserting the flat cable into the connector and connects the inserted flat cable to the connector. In this case, the slider is provided with protrusions which are formed in the side surfaces continued to both end faces of the mounting surface. On the other hand, the cover includes a longitudinal member extending in the widthwise direction of the terminal portion of the flat cable, and engagement members which hang along the side surfaces of the slider from both ends of such a longitudinal member and are provided with the respective openings capable of engaging with the protrusions of the side surfaces. When such a terminal connection tool is assembled to the terminal portion of the flat cable, the longitudinal member of the cover is positioned at the terminal portion mounted on the mounting surface of the slider, and the engagement member of the cover is pushed down along the side surfaces of the slider, thereby engaging the openings of the engagement members with the protrusions of the side surfaces of the slider. In this manner, the slider and the cover are assembled to each other in a state where the terminal portion is interposed therebetween. Thus, the terminal connection tool, which is constituted by the slider and the cover, and the flat cable are assembled to each other. Thus, the flat cable is electrically connected to the connector by inserting the terminal connection tool (slider and cover), which is assembled to the terminal portion, into the connector.

However, in the configuration disclosed in PTL 3, the terminal connection tool is constituted by the slider and the cover, and the slider and the cover are assembled to the flat cable. Accordingly, in the assembling between the flat cable and the terminal connection tool, it is necessary to assemble the flat cable, the slider, and the cover to each other, which results in a problem that it takes time for the work.

The second embodiment is contrived in view of such a situation, and addresses a first problem of suppressing the deflection of the flat cable in a direction opposite to the mounting surface, in a similar manner to the first embodiment described above. In addition, the second embodiment addresses a second problem of achieving a reduction in a work load for assembling the flat cable and the terminal connection tool to each other.

Hereinafter, an assembly structure of the flat cable (that is, a flexible integrated wiring) and the slider (that is, a flexible integrated wiring connector) according to the second embodiment (hereinafter, simply referred to as an assembly structure) will be described with reference to the accompanying drawings. The assembly structure according to the second embodiment is a structure for assembling a flat cable, which includes a conductor and a pair of coated portions with the conductor interposed therebetween, to a slider for inserting the flat cable into a connector for connection (that is, a connector of a connection counterparty). Meanwhile, in the assembly structure according to the invention, the following flat cable and slider are considered as the flat cable and the slider which are assembled to each other. The flat cable is a flexible cable, having a flat plate shape, which is used in order to achieve a reduction in a wiring space and an improvement in the degree of freedom of a wiring path in various types of electronic devices or electric devices. For example, a flexible printed circuit (FPC), a flexible flat cable (FFC), and the like are considered. The slider is a guide member (that is, a terminal connection tool) which guides a flat cable at the time of inserting the flat cable into a connector for connection with another electrical circuit and which serves as an interface for connecting the inserted flat cable to the connector.

Figure 10:
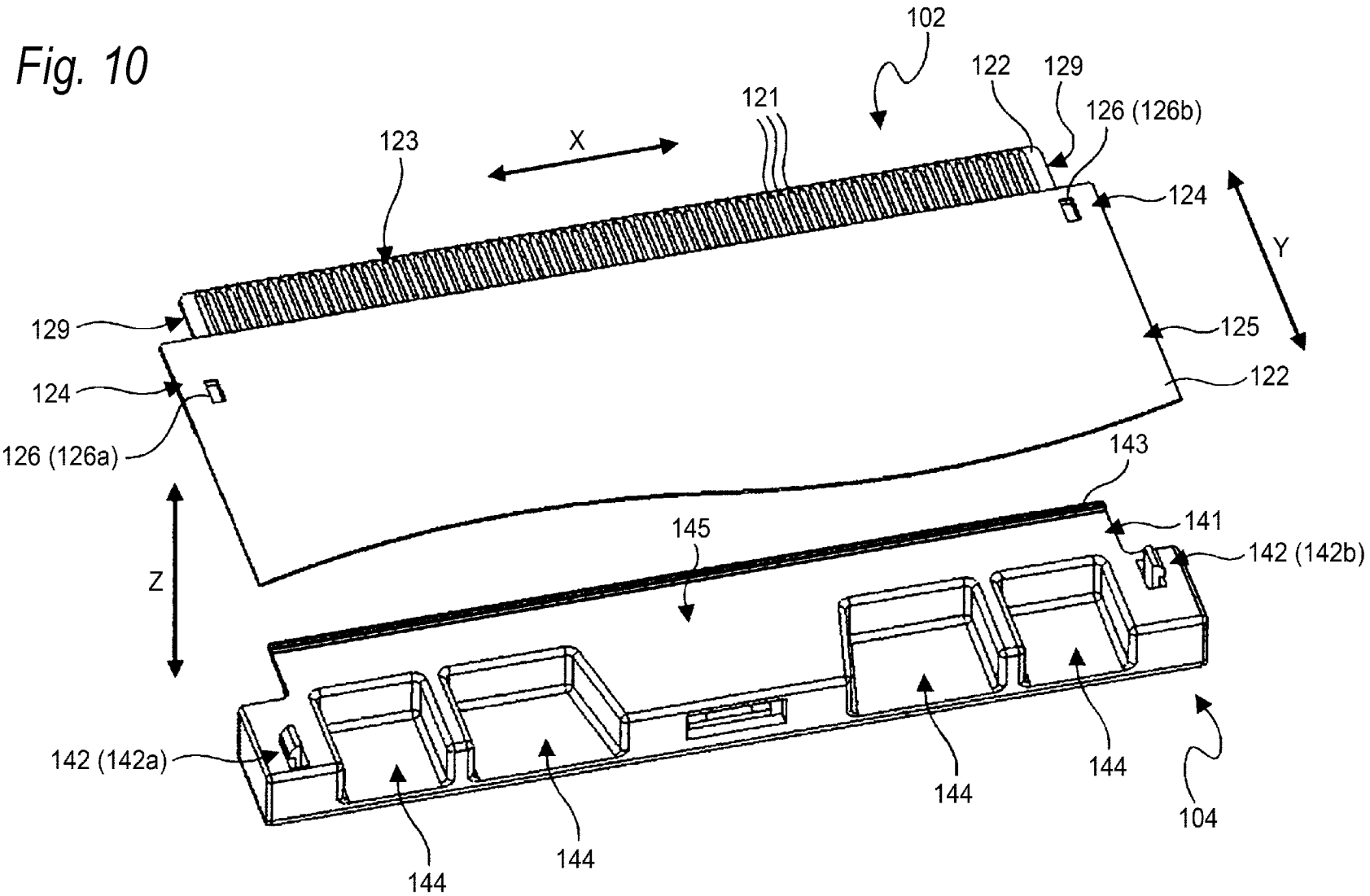
FIG. 10 is a diagram showing an assembly structure according to a second embodiment when viewed from a flat cable side.
Figure 11:
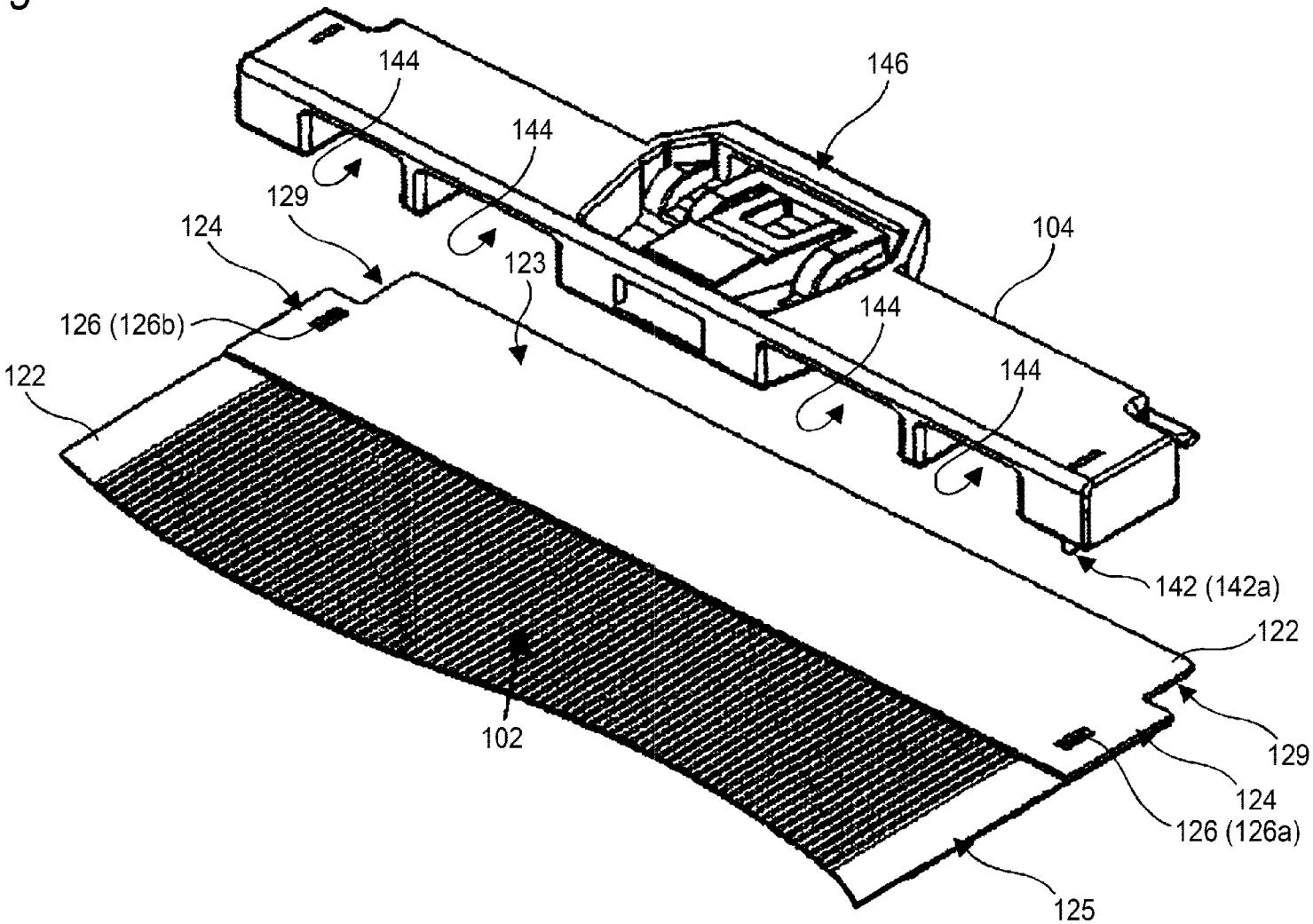
FIG. 11 is a diagram showing the assembly structure according to the second embodiment when viewed from a slider side.
Figure 12:
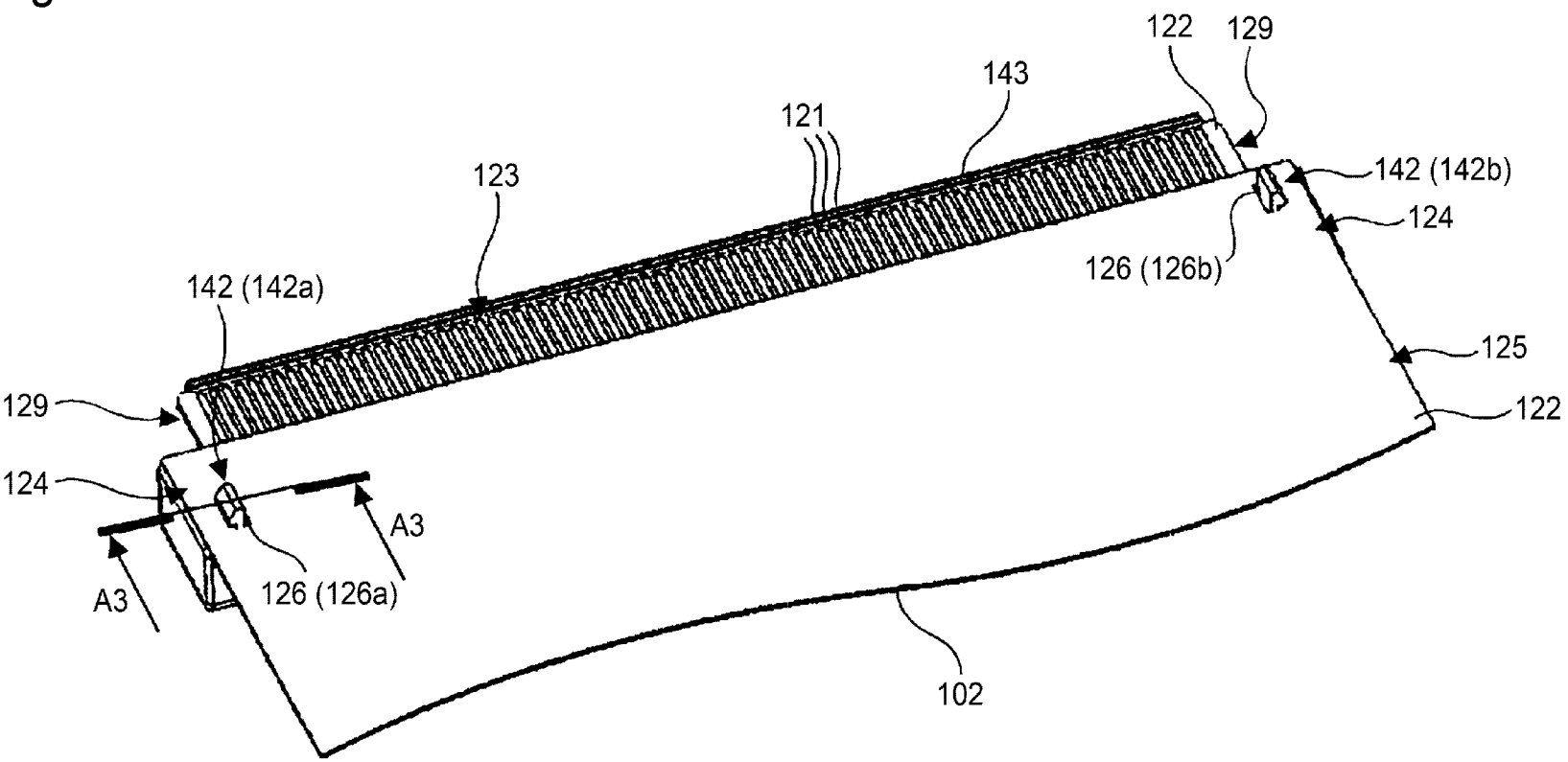
FIG. 12 is a diagram showing a state where the flat cable and the slider are assembled to each other.
Figure 13:
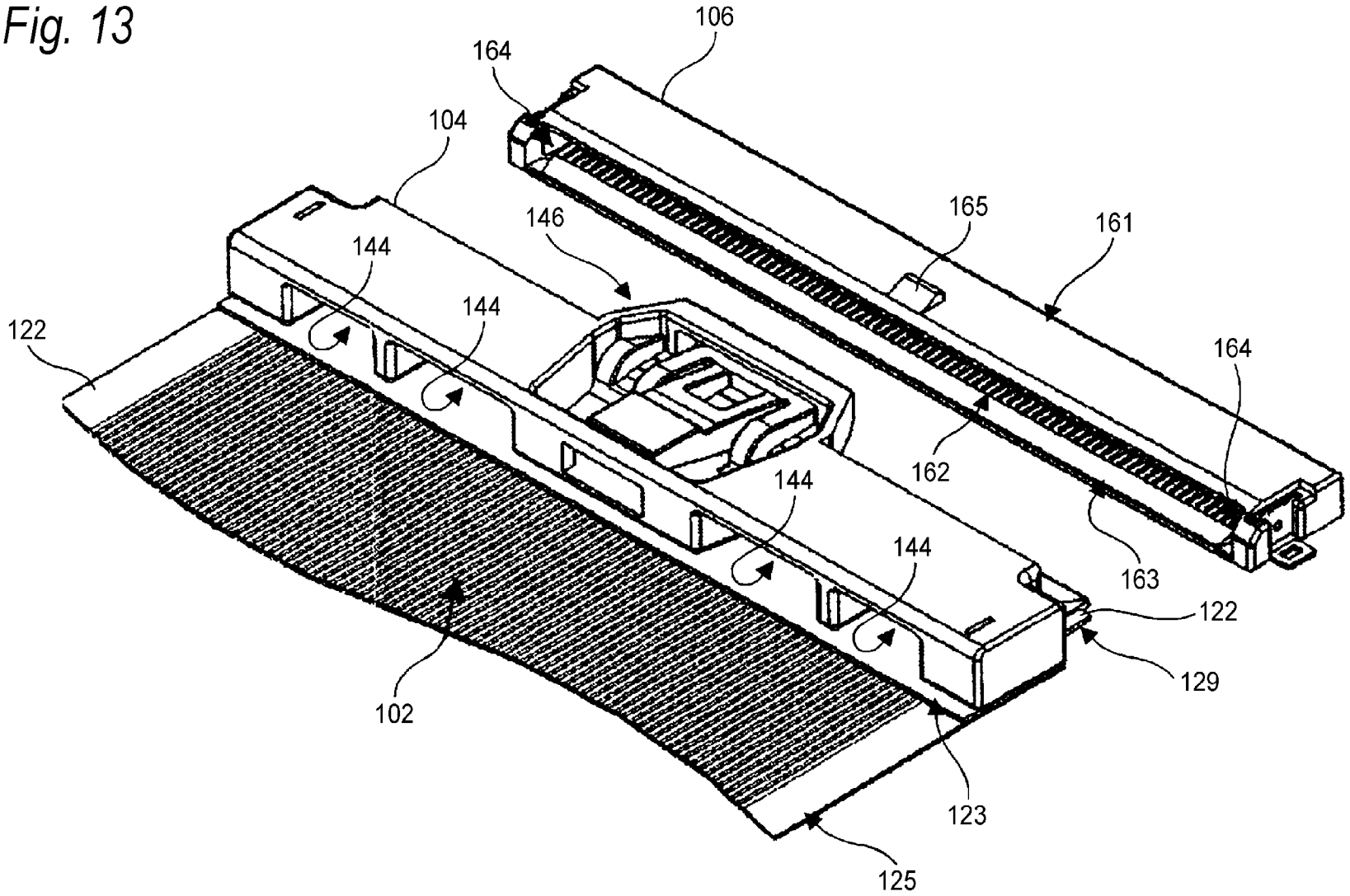
FIG. 13 is a perspective view illustrating the assembling of a connector to the flat cable and the slider which are assembled to each other.
Figure 14B:
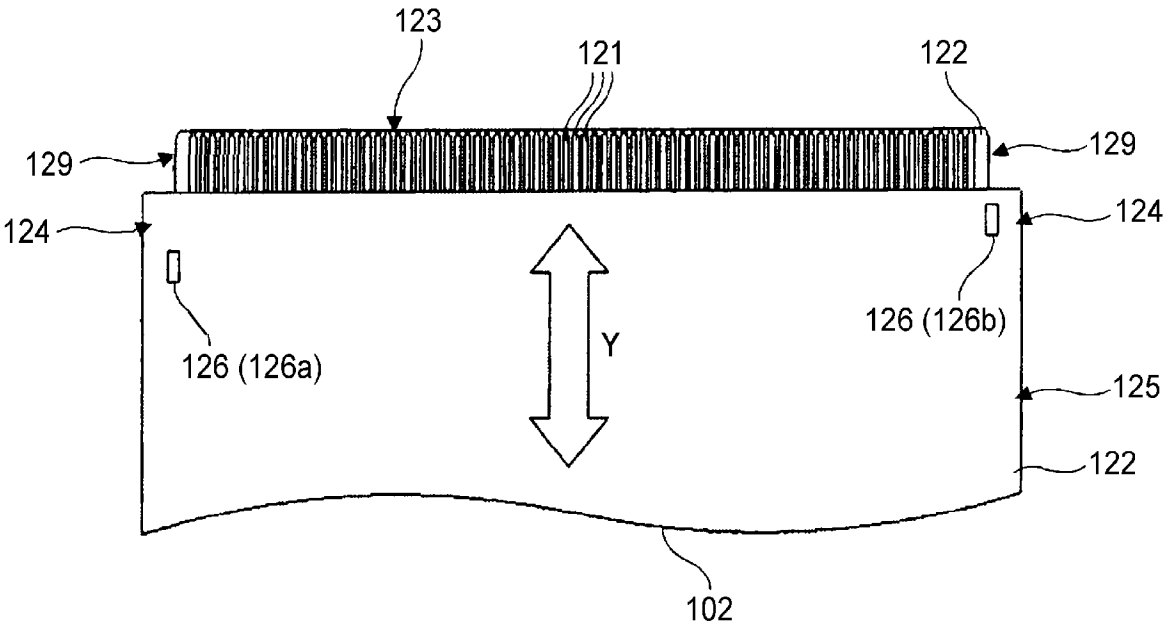
FIG. 14A and FIG. 14B are diagrams showing the configuration of the flat cable.
Figure 14A:
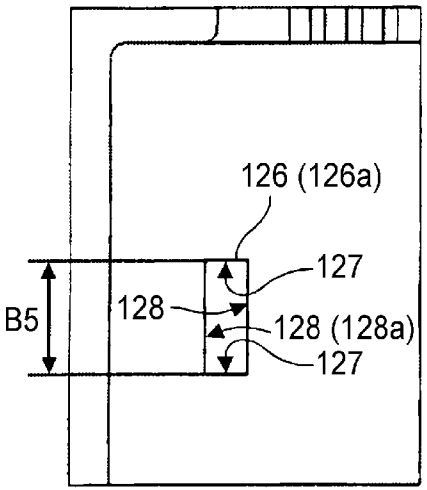
Figure 15B:
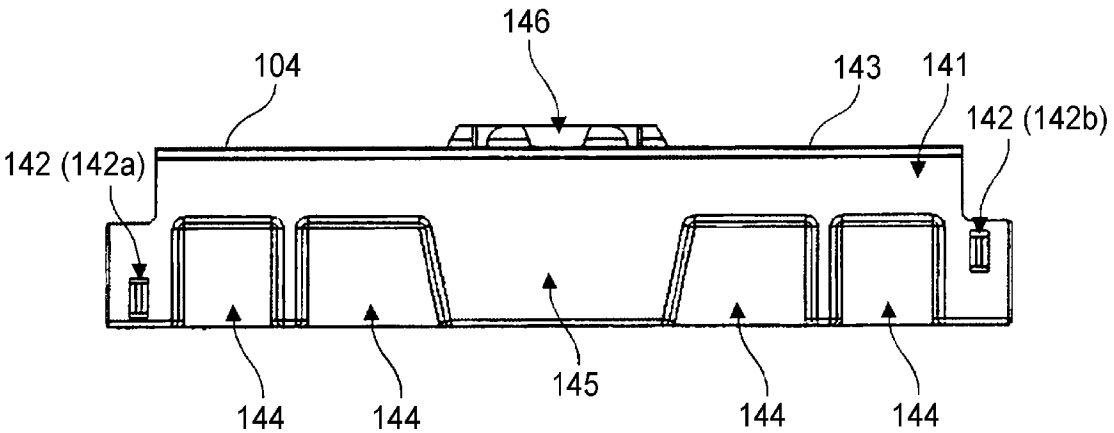
FIG. 15A and FIG. 15B are diagrams showing the configuration of the slider.
Figure 15A:
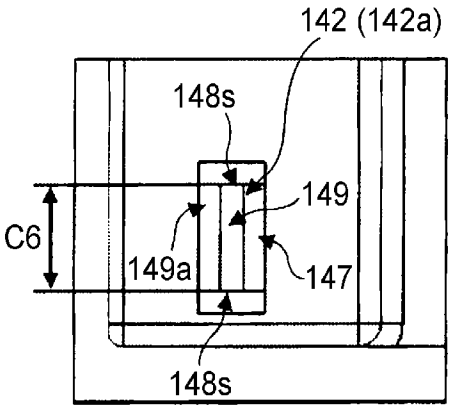

FIGS. 10 to 15 show the configuration of the assembly structure according to the second embodiment. FIG. 10 is a diagram showing the assembly structure when viewed from a flat cable 102 side, FIG. 11 is a diagram showing the assembly structure when viewed from a slider 104 side, FIG. 12 is a diagram showing a state where the flat cable 102 and the slider 104 are assembled to each other, and FIG. 13 is a perspective view illustrating the assembling of a connector 106 to the flat cable 102 and the slider 104 which are assembled to each other. In addition, FIGS. 14A and 14B are diagrams showing the configuration of the flat cable 102. FIG. 14A is a plan view when viewed from above, and FIG. 14B is an enlarged view of a portion of FIG. 14A. FIGS. 15A and 15B are diagrams showing the configuration of the slider 104. FIG. 15A is a plan view when viewed from above, and FIG. 15B is an enlarged view of a portion of FIG. 15A. Meanwhile, in the following description, the flat cable 102 side is referred to as an upper side and the slider 104 side is referred to as a lower side in a direction in which the flat cable 102 and the slider 104 are assembled to each other (in a direction of an arrow Z shown in FIG. 10).

As shown in FIGS. 10 and 11, the flat cable 102 includes a plurality of conductors 121 and a pair of coated portions 122 with the conductors 121 interposed therebetween. The conductor 121 is formed of a conductive material having a straight angle shape or a foil shape. The plurality of conductive materials are arranged in parallel to thereby constitute one flat cable 102. The coated portion 122 is formed of an insulating material (for example, an insulating film made of a resin) and is configured such that the plurality of conductors 121 are interposed between the upper side and the lower side in the form of a band across the longitudinal direction thereof. The flat cable 102 includes a terminal portion 123 for connection with another electrical circuit. In such a terminal portion 123, tip portions of the conductors 121 are exposed to the outside by removing the coated portion 122 on one side (upper side in FIG. 10) in an assembling direction Z of the conductors 121. In the flat cable 102, the total width of the coated portion 122 is set to be larger than the total width of the plurality of conductors 121 in the widthwise direction thereof (that is, a direction of an arrow X shown in FIG. 10). A portion which is constituted by only the coated portion 122 (hereinafter, referred to as a coated end portion 124) is provided on both sides of the total width of the conductors 121. In this case, the terminal portion 123 is configured such that the coated end portions 124 of both ends in the widthwise direction X are removed. Therefore, the flat cable 102 is configured such that the terminal portion 123 has a width smaller than that of an intermediate portion 125 other than the terminal portion.

In the second embodiment, the flat cable 102 includes opening portions 126 (that is, engagement holes) which are formed to pass through the coated portions 122 along the assembling direction Z to the slider 104. Specifically, the pair of opening portions 126 (126*a* and 126*b*) are formed in the respective coated end portions 124 of both ends in the widthwise direction X and in the vicinity of the terminal portion 123 in the longitudinal direction (that is, in a direction of an arrow Y shown in FIG. 10). The opening portions 126 engage with engagement portions 142 to be described later. Meanwhile, the configuration (that is, a shape, a size, an arrangement, and the like) of the opening portion 126 can be arbitrarily set as long as it is a portion which is capable of engaging with the engagement portion 142. FIGS. 10 to 14B show an example of the configuration of the opening portion 126 having a rectangular shape in which the longitudinal direction thereof is long with respect to the widthwise direction X of the flat cable 102. Meanwhile, the longitudinal direction Y is equivalent to a direction in which the flat cable 102 is inserted into the connector 106 (in other words, a front-back direction of the flat cable 102). In this case, the opening portions 126 are formed such that edge portions 127 of both sides thereof in the longitudinal direction Y face each other in parallel along the widthwise direction X and such that edge portions 128 of both sides thereof in the widthwise direction X face each other in parallel along the longitudinal direction Y.

The slider 104 includes a mounting portion 141 on which the terminal portion 123 of the flat cable 102 is mounted, and the engagement portions 142 (that is, engagement hooks) which are formed to protrude further than the mounting surface 145 of the terminal portion 123 in the mounting portion 141 and engage with the flat cable 102. In this case, the slider 104 is configured as a structure having a length depending on the width of the flat cable 102 (in other words, the total width of the coated portion 122), and the mounting portion 141 having the terminal portion 123 mounted thereon is formed on one side of the slider in the assembling direction Z (on the upper side in FIG. 10). In the mounting portion 141, a protrusion portion 143 abutting on a front edge (that is, a tip edge) of the terminal portion 123 and positioning the terminal portion 123 is provided so as to extend. At this time, the extension height of the protrusion portion 143 may be set to be substantially the same as or to be slightly larger than the thickness of the flat cable 102. In addition, the mounting portion 141 is configured such that weight reduction is achieved by concave portions 144 formed by partially thinning the mounting portion and such that the mounting surface 145 having the terminal portion 123 mounted thereon is formed in a flat portion other than the concave portion 144. Meanwhile, the number and size of concave portions 144 are not particularly limited as long as the size of the mounting surface 145, the strength of the slider 104, and the like can be sufficiently secured. FIG. 10 shows an example of the configuration of the mounting portion 141 having four concave portions 144. Meanwhile, the slider 104 includes a connector engagement portion 146 for engaging the connector 106 connected to the flat cable 102, on the side opposite to the mounting portion 141 in the assembling direction Z.

Figure 16:
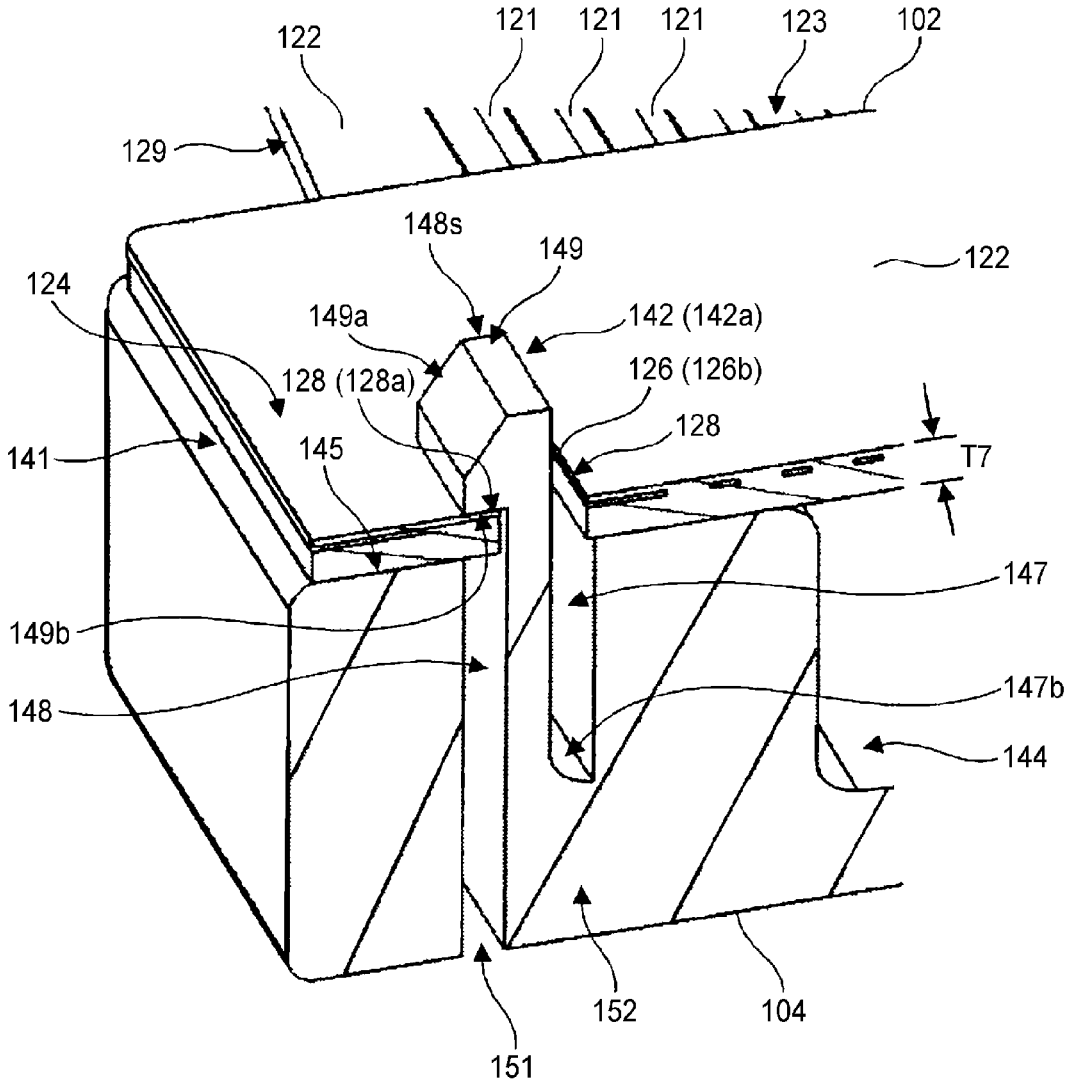
FIG. 16 is a diagram showing a longitudinal section of a portion shown by an arrow A3 of FIG. 12 when viewed from a direction of the arrow, and is a perspective view showing a state where the flat cable and the slider are assembled to each other when viewed from above.
Figure 17:
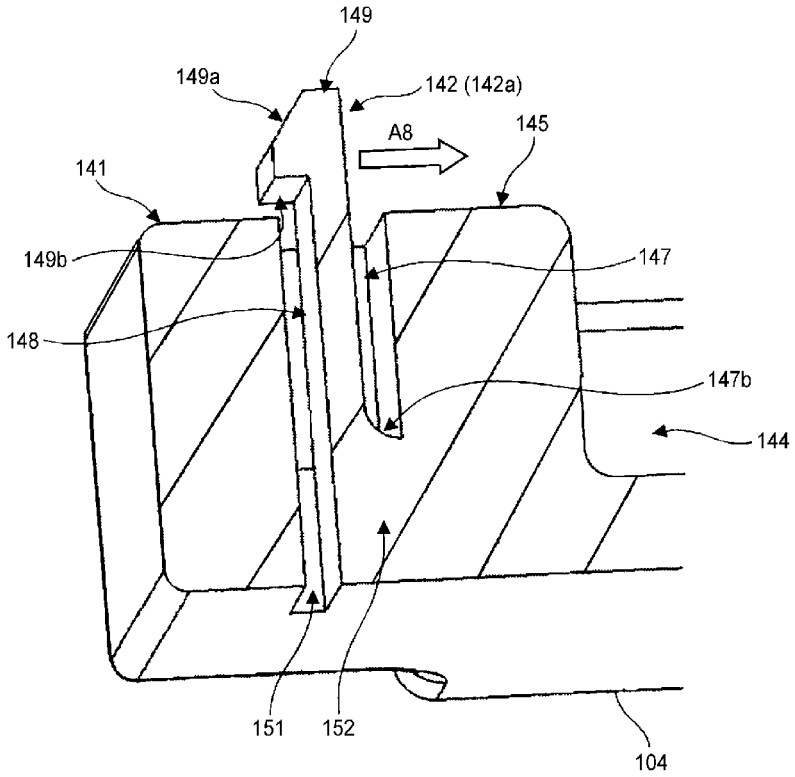
FIG. 17 is a diagram showing the longitudinal section of the portion shown by the arrow A3 of FIG. 12 when viewed from a direction of the arrow, and is a perspective view showing a single body of the slider when viewed from below.

FIGS. 16 and 17 show the configuration of the engagement portion 142 according to this embodiment. FIGS. 16 and 17 are diagrams showing a longitudinal section in a portion shown by an arrow A3 of FIG. 12 when viewed from a direction of the arrow. FIG. 16 is a perspective view showing a state where the flat cable 102 and the slider 104 are assembled to each other when viewed from above, and FIG. 17 is a perspective view showing a single body of the slider 104 when viewed from below. As shown in FIGS. 16 and 17, the engagement portion 142 includes an engraved portion 147 which is formed to be recessed to the body side of the slider 104 (in other words, the lower side) from the mounting surface 145, an arm portion 148, having flexibility, which extends from a bottom 147*b* of the engraved portion 147 and is formed to protrude further than the mounting surface 145, and a barb portion 149 which protrudes from a protrusion end of the arm portion 148 and engages with the opening portion 126 (that is, the engagement hole). Meanwhile, in order to give flexibility to the arm portion 148, it is preferable that the slider 104 or the engagement portion 142 be formed of an elastic material such as, for example, a resin. In the second embodiment, the pair of engagement portions 142 (142*a* and 142*b*) are provided in both ends of the slider 104 in the widthwise direction X so as to correspond to the opening portions 126 (126*a* and 126*b*) of the flat cable 102. In this case, the configuration (that is, a shape, a size, an arrangement, and the like) of the engagement portion 142 can be arbitrarily set as long as it is a portion capable of engaging with the opening portion 126. In the second embodiment, a width between the pair of engagement portions 142 is set to be slightly smaller than a width between the pair of opening portions 126.

In the engagement portion 142, a hole 151 is bored along the arm portion 148 on the side at which the barb portion 149 protrudes with respect to the arm portion 148 (in other words, on the side opposite to the engraved portion 147 with the arm portion 148 interposed therebetween). Such a hole 151 passes through the slider 104 in the assembling direction Z to the flat cable 102. That is, the arm portion 148 is configured to protrude over the mounting surface 145 of the mounting portion 141 upwards in the assembling direction Z to the flat cable 102 from the bottom 147*b* of the engraved portion 147, in other words, is configured to be continued to the slider 104 in a residual wall portion in the bottom 147*b* of the engraved portion 147. In addition, the engraved portion 147 has the bottom 147*b* and is configured as a hole portion that opens to the mounting surface 145. Thus, the arm portion 148 can be deflected and deformed to the engraved portion 147 side and the hole 151 side by falling in the engraved portion 147 or the hole 151. In this case, the sizes of the engraved portion 147 and the hole 151 in the longitudinal direction Y are set to be slightly larger than the width of the arm portion 148. In addition, the thickness of the residual wall portion in the bottom 147*b* of the engraved portion 147 which serves a portion (that is, a base end portion of the arm portion 148) 152 of the arm portion 148 which is continued to the slider 104, in other words, the depth of the engraved portion 147 affects the length of the protrusion (specifically, flexibility) of the arm portion 148. The thickness (that is, the depth) may be set to be capable of causing the arm portion 148 to have sufficient flexibility to the engraved portion 147 side and the hole 151 side. Meanwhile, in the second embodiment, the hole 151 is formed as a through hole which is bored to pass through the slider 104 in the assembling direction Z. However, the hole can also be configured as a hole portion which has a bottom and is opened to the mounting surface 145 without passing through the slider 104 (that is, configured in the same manner as the engraved portion 147).

In this embodiment, the size (that is, a distance C6 shown in FIG. 15) of the arm portion 148 in a direction in which the flat cable 102 is inserted into the connector 106, in other words, in the longitudinal direction Y is set to be substantially the same (that is, C6≅B5) as an interval (that is, a distance B5 shown in FIG. 14A) between the edge portions 127, facing each other in the longitudinal direction Y, in the opening portions 126 of the flat cable 102. Therefore, front and back engagement surfaces 148*s* of the engagement portion 142 (specifically, the arm portion 148) can interfere with the facing edge portions 127, in other words, can be held between the edge portions 127 in a state where the arm portion 148 is inserted into the opening portions 126. Thus, it is possible to reliably engage the flat cable 102 with the slider 104 in the longitudinal direction Y (that is, in a direction in which the flat cable 102 is inserted into the connector 106) and to perform the positioning of the flat cable. Meanwhile, the size of the arm portion 148 in the widthwise direction X may be set to be slightly smaller than an interval between the edge portions 128, facing each other in the widthwise direction X, in the opening portions 126 of the flat cable 102.

The barb portion 149 is provided to protrude outward (that is, to the hole 151 side with respect to the arm portion 148) in the widthwise direction X from the protrusion end of the arm portion 148. In this case, the barb portion 149 has an inclination surface (hereinafter, referred to as a take-up portion) 149*a* which is gradually inclined inwards from the outer side thereof in the widthwise direction X, and is configured to be tapered toward an extending end of the arm portion 148. Accordingly, the take-up portion 149*a* of the barb portion 149 serves as a guide portion for the opening portion 126 at the time of assembling the flat cable 102 to the slider 104, and thus it is possible to cause the barb portion 149 and the arm portion 148 to be smoothly inserted into the opening portion 126. Meanwhile, the coated end portion 124 having the opening portion 126 formed therein is constituted by only the coated portion 122, and thus can be elastically deformed. Therefore, the barb portion 149 protruding from the protrusion end of the arm portion 148 can be inserted into the opening portion 126 by the guiding of the take-up portion 149*a* by slightly enlarging the opening portion 126 using elastic deformation. In this embodiment, the barb portion 149 is provided so as to protrude outward in the widthwise direction X, but the protrusion direction of the barb portion 149 is not limited thereto. For example, in the second embodiment, the arm portion 148 is configured to fall in the engraved portion 147, and thus is capable of being deflected and deformed to the engraved portion 147 side. The arm portion is also configured to fall in the hole 151, and thus is capable of being deflected and deformed to the hole 151 side. Accordingly, the barb portion can also be provided to protrude inwards in the widthwise direction X (that is, to the engraved portion 147 side with respect to the arm portion 148). That is, the barb portion can also be configured to protrude in any direction as long as it is a direction conforming to the bending direction of the arm portion. For example, a configuration may also be adopted in which the barb portion protrudes frontward or backward in the longitudinal direction Y.

In addition, the barb portion 149 has a return surface 149*b* which faces the mounting portion 141 (specifically, the mounting surface 145) with an interval, corresponding to the thickness of the flat cable 102, therebetween (that is, a distance T7 shown in FIG. 16). The return surface 149*b* engages with the opening portion 126 into which the arm portion 148 is inserted. In this case, the return surface 149*b* is formed to be parallel with the surface (in other words, the vicinity of the edge portion 128) of the coated end portion 124 of the coated portion 122 on the upper side so as to be capable of engaging with the opening portion 126 on the entirety of the surface. Thus, it is possible to bring the entirety of the return surface 149*b* into close contact with the surface of the coated end portion 124 in a state where the arm portion 148 is inserted into the opening portion 126 and to reliably engage the barb portion 149 with the opening portion 126.

Here, in assembling the flat cable 102 and the slider 104, the opening portion 126 may engage with the engagement portion 142 (more specifically, the barb portion 149) through an example of the following procedure.

In this case, first, the slider 104 is left standing, and the flat cable 102 is positioned in the assembling direction Z (for example, in the vertical direction) with respect to the slider 104. At this time, the mounting surface 145 of the mounting portion 141 of the slider 104 is made to face the lower sides of the terminal portion 123 of the flat cable 102 (in other words, the coated sides (unexposed sides) of the conductors 121 in the terminal portion 123) (a state shown in FIG. 10). From this state, the flat cable 102 is moved downwards (for example, to the lower side in the vertical direction) while aligning the position of the opening portion 126 with the engagement portion 142, specifically, the position of the take-up portion 149*a* of the barb portion 149, and the edge portion 128 (specifically, the edge portion 128*a* on the outer side in the widthwise direction X) of the opening portion 126 is made to abut on the take-up portion 149*a*. Then, a pressing force is applied downwards to the flat cable 102, and such a pressing force is made to act on the barb portion 149 through the take-up portion 149*a* from the edge portion 128*a* of the opening portion 126, thereby deflecting and deforming the arm portion 148 inwards (that is, to the engraved portion 147 side (for example, in a direction of an arrow A8 shown in FIG. 17)) in the widthwise direction X.

The flat cable 102 is moved downwards in a state where the pressing force acts in this manner, and thus the barb portion 149 is inserted into the opening portion 126 while sliding the edge portion 128*a* along the take-up portion 149*a*. At this time, the opening portion 126 is slightly enlarged by the elastic deformation thereof by using the pressing force. Then, the flat cable 102 is moved further downwards until a state is set in which the terminal portion 123 abuts and is mounted on the mounting surface 145 of the mounting portion 141. When the flat cable 102 is moved until this state is set, the pressing force having acted on the barb portion 149 from the edge portion 128*a* of the opening portion 126 through the take-up portion 149*a* does not act, and thus the arm portion 148 is deflected and deformed to be restored outward (that is, to the hole 151 side) in the widthwise direction X. Meanwhile, in this state, the arm portion 148 is inserted into the opening portion 126, and the front edge (that is, tip edge) of the terminal portion 123 abuts on the protrusion portion 43 of the mounting portion 141, and thus the positioning of the flat cable 102 with respect to the slider 104 is performed.

Thus, the opening portion 126 engages with the barb portion 149. More specifically, the edge portion 128*a* of the opening portion 126 engages with the return surface 149*b* of the barb portion 149 (see FIG. 16). That is, the flat cable 102 and the slider 104 can be assembled to each other in a state where they engage with each other (state shown in FIG. 12). Meanwhile, in this state, the front and back engagement surfaces 148*s* of the arm portion 148 can interfere with the facing edge portions 127 of the opening portion 126, in other words, can be held between the edge portions 127. As a result, it is possible to reliably engage the flat cable 102 with the slider 104 in the longitudinal direction Y (that is, in a direction in which the flat cable 102 is inserted into the connector 106) and to perform the positioning of the flat cable. In this state, the conductor 121 of the terminal portion 123 in the flat cable 102 is exposed to the outside, and both end faces 129 of the terminal portion 123 in the widthwise direction X are exposed to the outside.

In addition, when a force for separating the flat cable 102 and the slider 104 from each other in the assembling direction Z (hereinafter, referred to as a lock releasing force) acts in a state where the flat cable 102 and the slider 104 are assembled to each other, for example, when a lock releasing force for moving the flat cable 102 upward (for example, to the upper side in the vertical direction) acts, the edge portion 128*a* of the opening portion 126 and the return surface 149*b* of the barb portion 149 interfere with each other, and a force for deflecting and deforming the arm portion 148 inwards (that is, to the engraved portion 147 side (in a direction of the arrow A8 shown in FIG. 17)) in the widthwise direction X is applied. When the lock releasing force continuously acts in this state, it is possible to release the engagement between the edge portion 128*a* of the opening portion 126 and the return surface 149*b* of the barb portion 149. Therefore, it is also possible to separate the flat cable 102 and the slider 104 from each other from a state where the flat cable and the slider are assembled to each other. That is, it is possible to detachably assemble the flat cable 102 and the slider 104 to each other.

Meanwhile, the flat cable 102 assembled to the slider 104 can be assembled to the connector 106 by inserting the slider 104 into the connector 106. Thus, it is possible to connect the flat cable 102 to another electrical circuit through the connector 106. As shown in FIG. 13, the connector 106 includes a housing 161 and a terminal portion 162 which is constituted by a plurality of connection terminals provided within the housing 161. The housing 161 is formed of, for example, a resin material having an insulating property, and includes a fitting portion 163 for fitting the inserted flat cable 102. In the fitting portion 163, accommodation grooves accommodating the terminal portion 162 are provided to extend in the longitudinal direction Y and to be lined up in the widthwise direction X.

In addition, the fitting portion 163 includes a pair of wall portions 164 for performing positioning by causing the flat cable 102, which is inserted into both end portions in the widthwise direction X, to abut thereon. In this case, a distance between the pair of wall portions 164 in the widthwise direction X is set to be slightly larger than a distance between both end faces 129 of the terminal portion 123. In addition, the housing 161 is provided with a locking claw 165 for preventing the falling of the flat cable 102 which is inserted and fitted into the fitting portion 163 (in other words, which is connected to the connector 106). Accordingly, the locking claw 165 engages with the connector engagement portion 146 of the slider 104 assembled to the flat cable 102, and thus it is possible to hold the flat cable 102 in a state where the flat cable is connected to the connector 106. In the terminal portion 162, the connection terminals are aligned with the accommodation grooves of the fitting portion 163. The terminal portion is accommodated in the fitting portion 163 with the connection terminals facing the outside. In this case, the number of connection terminals of the terminal portion 162 corresponds to the number of conductors 121 which are exposed in the terminal portion 123 of the flat cable 102.

When connecting the flat cable 102, which is assembled to the slider 104, to the connector 106, the terminal portion 123 may be inserted into the fitting portion 163 and the locking claw 165 may engage with the connector engagement portion 146 through an example of the following procedure.

In this case, first, the flat cable 102 is positioned with respect to the connector 106 so that the conductor 121 exposed to the terminal portion 123 of the flat cable 102 can come into contact with the terminal portion 162 facing the outside in the fitting portion 163 of the connector 106. From this state, the terminal portion 123 is inserted into the fitting portion 163. At this time, the flat cable 102 is positioned with respect to the connector 106 while causing both end faces 129 of the terminal portion 123 to abut on the wall portion 64. Then, the terminal portion 123 is inserted into the fitting portion 163 until a state is set in which the locking claw 165 engages with the connector engagement portion 146. Thus, it is possible to bring the conductor 121 of the terminal portion 123 into contact with the terminal portion 162 of the connector 106 and to electrically connect the flat cable 102 and the connector 106 to each other. In addition, it is possible to hold such an electrical connection state between the flat cable 102 and the connector 106 by the engagement between the connector engagement portion 146 and the locking claw 165. As a result, it is possible to connect the flat cable 102 to another electrical circuit through the connector 106.

In this manner, according to the assembly structure of the second embodiment, it is possible to easily assemble the flat cable 102 and the slider 104 to each other by only engaging the opening portion 126 with the engagement portion 142 (specifically, the barb portion 149). In this case, the terminal connection tool, serving as an interface for connecting the flat cable 102 to the connector 106, can be constituted by only the slider 104. For this reason, the flat cable 102 and the slider 104 can be directly assembled to each other. For example, the flat cable 102 is not required to be assembled to the slider 104 through a covering member or the like. Thus, it is possible to reduce a work load for assembling the flat cable 102 and the terminal connection tool to each other.

Meanwhile, in this embodiment, the pair of opening portions 126 (126*a* and 126*b*) and the pair of engagement portions 142 (142*a* and 142*b*) corresponding to the opening portions are disposed so as to be shifted back and forth in the longitudinal direction Y. FIGS. 10 to 12 show an example of a configuration in which the opening portion 126*a* and the engagement portion 142*a* are disposed separated further from the terminal portion 123 in the longitudinal direction Y than the opening portion 126*b* and the engagement portion 142*b*. The opening portion 126 and the engagement portion 142 are disposed in this manner, and thus one opening portion 126*a* can engage with only one engagement portion 142*a*, and the other opening portion 126*b* can engage with only one engagement portion 142*b*. Accordingly, it is possible to uniquely determine a direction of the engagement between the flat cable 102 and the slider 104. Specifically, a configuration can be adopted in which the opening portions 126*a* and 126*b* can engage with the engagement portions 142*a* and 142*b*, respectively, only in a state where the lower side (in other words, the coated side (unexposed side) of the conductor 121 in the terminal portion 123) of the terminal portion 123 is made to face the mounting surface 145 of the mounting portion 141 (state shown in FIG. 10). Thus, the erroneous mounting of the terminal portion 123 on the mounting portion 141, in other words, an assembling error of the flat cable 102 to the slider 104 is prevented. Meanwhile, for example, even when a configuration is adopted in which the pair of opening portions and the pair of engagement portions corresponding to the opening portions are disposed asymmetrically in the widthwise direction X, the same effect of preventing an assembling error can be obtained. In addition, even in a configuration in which shapes of one opening portion and engagement portion are different from shapes of the other opening portion and engagement portion, the same effect can be obtained. For example, one opening portion and one engagement portion may be formed to have a rectangular shape which is larger than that of the other opening portion and the other engagement portion in the longitudinal direction Y or the widthwise direction X. Alternatively, one opening portion and one engagement portion may be formed to have a circular shape and the other opening portion and the other engagement portion may have an elliptical shape.

Figure 18:
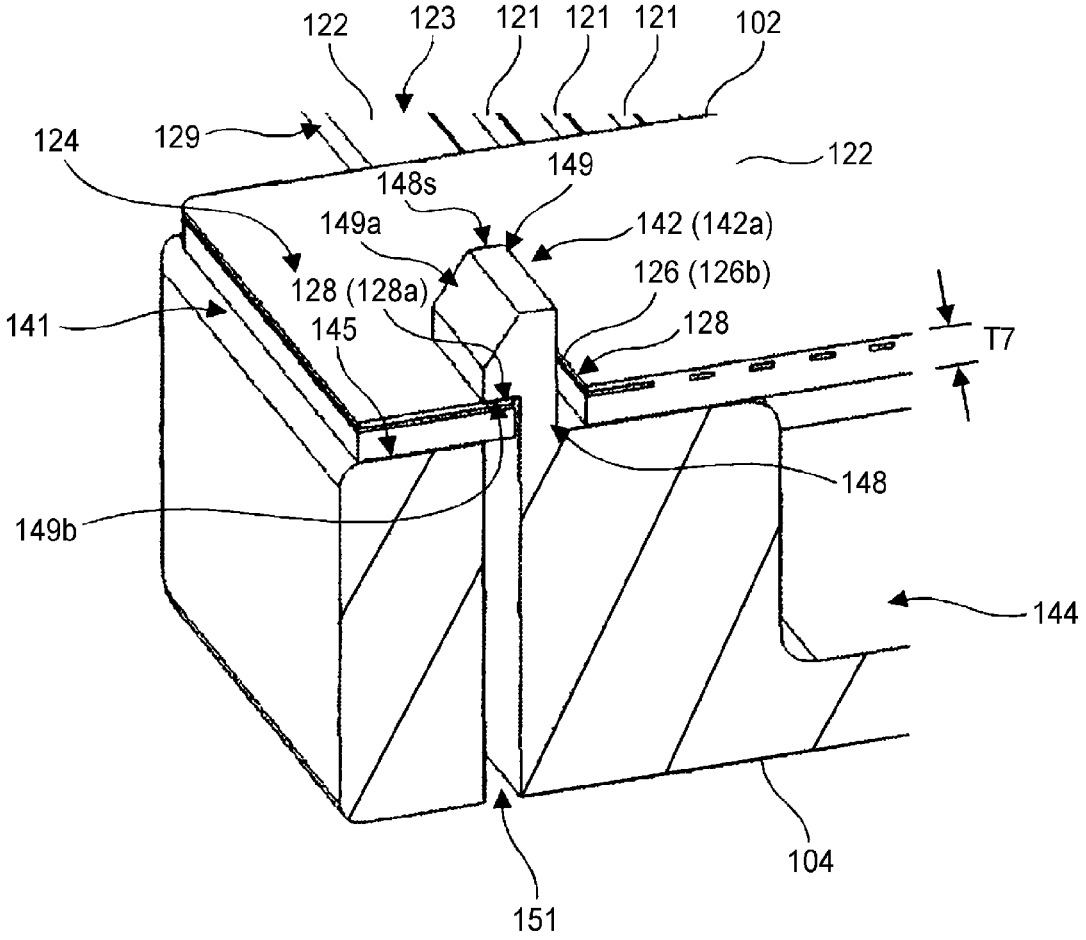
FIG. 18 is a diagram showing a longitudinal section equivalent to the portion shown by the arrow A3 of FIG. 12 when viewed from a direction of the arrow, and is a perspective view showing a state where the flat cable and the slider are assembled to each other when viewed from above.
Figure 19:
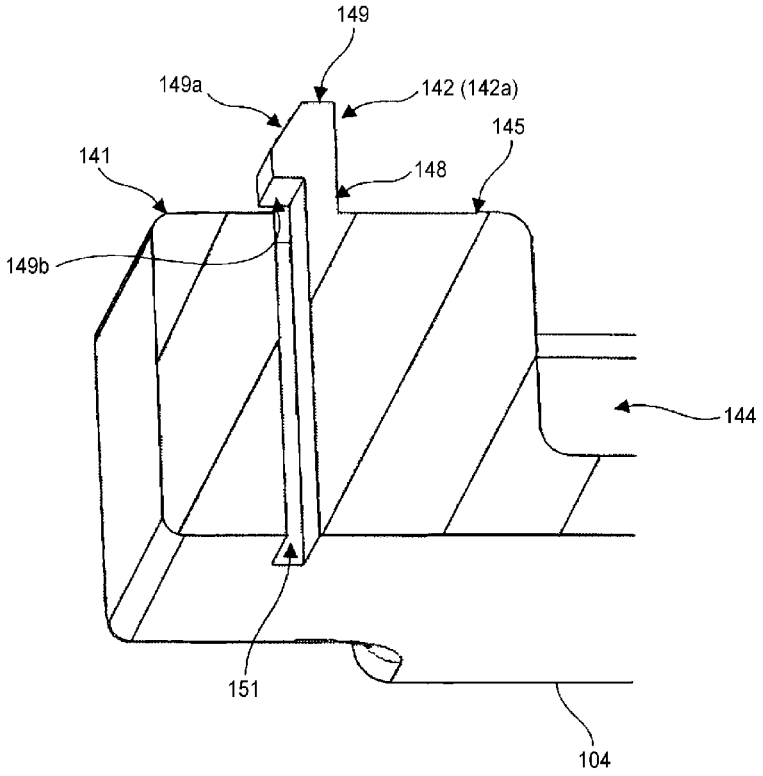
FIG. 19 is a diagram showing a longitudinal section equivalent to the portion shown by the arrow A3 of FIG. 12 when viewed from a direction of the arrow, and is a perspective view showing a single body of the slider when viewed from below.

In this embodiment, the engraved portion 147 (that is, the hole portion of the mounting portion 141) is formed to give sufficient flexibility to the arm portion 148. However, as in the configuration shown in FIGS. 18 and 19, the engagement portion 142 may be configured such that the arm portion 148 is provided by boring only the hole 151 without forming the engraved portion 147 (in other words, the hole portion) in the mounting portion 141. In this case, the arm portion 148 is configured to protrude from the mounting surface 145 in the assembling direction Z to the flat cable 102. Meanwhile, FIGS. 18 and 19 are diagrams showing a longitudinal section equivalent to the portion shown by the arrow A3 of FIG. 12 when viewed from a direction of the arrow. FIG. 18 is a perspective view showing a state where the flat cable 102 and the slider 104 are assembled to each other when viewed from above, and FIG. 19 is a perspective view showing a single body of the slider 104 when viewed from below.

Here, characteristics of the slider 104 according to the second embodiment described above will be collectively listed in (1) to (3) below in a concise manner.

(1) The slider 104 according to the second embodiment (corresponding to the flexible integrated wiring connector according to the first embodiment) is used when the terminal portion 123 of the flat cable 102 (corresponding to the flexible integrated wiring according to the first embodiment) is inserted into and connected to the connector 106 of a connection counterparty. The slider 104 includes the mounting surface 145 on which the terminal portion 123 and the coated portion 122 are mounted, and the pair of engagement portions 142 (142*a* and 142*b*) (corresponding to the engagement hooks according to the first embodiment) which are formed respectively on both end sides of the mounting surface 145 in the widthwise direction. The pair of engagement portions 142 (142*a* and 142*b*) engage with the pair of opening portions 126 (126*a* and 126*b*) (corresponding to the engagement holes according to the first embodiment) which are bored respectively on both end sides of the coated portion 122 in the widthwise direction.

(2) In the slider 104 according to the second embodiment, a width between the pair of engagement portions 142 is slightly smaller than a width between the pair of opening portions 126.

(3) In the slider 104 according to the second embodiment, the engagement portion 142 includes the engraved portion 147 which is formed in the mounting surface 145, the arm portion 148, having flexibility, which extends from the bottom 147*b* of the engraved portion 147 and is formed to protrude further than the mounting surface 145, and the barb portion 149 which protrudes from the protrusion end of the arm portion 148 and engages with the opening portion 126.

In addition, characteristics of the assembly structure according to the second embodiment described above will be collectively listed in (4) below in a concise manner.

(4) The assembly structure according to the second embodiment is an assembly structure including the flat cable 102, which includes the conductors 121 and the pair of coated portions 122 with the conductors 121 interposed therebetween, and the slider 104 for inserting the flat cable 102 into the connector 106 for connection. The flat cable 102 includes the opening portions 126 formed by being penetrated by the coated portion 122. The slider 104 includes the mounting surface 145 on which the terminal portion 123 of the flat cable 102 is mounted, and the engagement portion 142 which is formed to protrude further than the mounting surface 145 of the terminal portion in the mounting surface 145 and engages with the flat cable 102. The engagement portion 142 is configured to include the engraved portion 147 which is formed to be recessed on the body side of the slider 104 from the mounting surface 145, the arm portion 148, having flexibility, which is formed to protrude further than the mounting surface 145 from the bottom 147*b* of the engraved portion 147, and the barb portion 149 which protrudes from the protrusion end of the arm portion 148 and engages with the opening portion 126.

Accordingly, the opening portions 126 of the flat cable 102 engage with the engagement portions 142 (specifically, the barb portion 149) of the slider 104, and thus it is possible to directly and easily assemble the flat cable 102 to the slider 104. In addition, it is also possible to separate the flat cable 102 and the slider 104 from each other from a state where the flat cable and the slider are assembled to each other. That is, it is possible to detachably assemble the flat cable 102 and the slider 104 to each other.

As a result, it is possible to achieve a reduction in a work load for assembling the flat cable 102 and the terminal connection tool to each other, in addition to suppressing the deflection of the flat cable 102 in a direction opposite to the mounting surface 145.

This application is based on a Japanese patent application filed on Jun. 27, 2012 (Japanese Patent Application No. 2012-143597) and a Japanese patent application filed on Jul. 2, 2012 (Japanese Patent Application No. 2012-148742), the entire contents thereof being thereby incorporated by reference. In addition, all of the references cited herein are incorporated as a whole.

A flexible integrated wiring connector according to the invention is useful for suppressing the deflection of a flexible integrated wiring in a direction opposite to a mounting surface.

What is claimed is:

1. A flexible integrated wiring connector which is used when a terminal portion of a flexible integrated wiring is inserted into and connected to a connector of a connection counterparty, the flexible integrated wiring connector comprising:

a mounting surface on which the terminal portion is mounted; and a pair of engagement hooks which are formed respectively on both end sides of the mounting surface in a widthwise direction, wherein the pair of engagement hooks engage with a pair of engagement holes which are bored respectively on both end sides of the terminal portion in the widthwise direction, wherein the pair of engagement hooks are offset from each other in an insertion direction of the terminal portion.

2. The flexible integrated wiring connector according to claim 1, wherein a width between end portions of the pair of engagement hooks is slightly smaller than a width between surfaces of the pair of engagement holes.

3. The flexible integrated wiring connector according to claim 1, wherein a protrusion portion is formed in each of both ends of the mounting surface in the widthwise direction.

4. The flexible integrated wiring connector according to claim 1, wherein a tapered portion is formed on each of both end sides of the mounting surface in the widthwise direction, the tapered portion being inclined so that an amount of protrusion thereof increases toward the both end sides from a center side.

5. The flexible integrated wiring connector according to claim 1, wherein the engagement hook includes an engraved portion which is formed on the mounting surface, an arm portion, having flexibility, which extends from a bottom of the engraved portion and is formed to protrude further than the mounting surface, and a barb portion which protrudes from a protrusion end of the arm portion and engages with the engagement hole.

* * * * *